US005581859A

United States Patent [19]

Busenhart

[11] Patent Number: 5,581,859

[45] Date of Patent: Dec. 10, 1996

[54] THREAD TREATING NOZZLE WITH ELASTIC PLATE

[75] Inventor: Peter Busenhart, Wiesendangen, Switzerland

[73] Assignee: Maschinenfabrik Rieter AG, Winterthur, Switzerland

[21] Appl. No.: 602,016

[22] Filed: Feb. 15, 1996

[30] Foreign Application Priority Data

Feb. 16, 1995 [CH] Switzerland ..... 004437/95

[51] Int. Cl.[6] ..... D02G 1/16

[52] U.S. Cl. ..... 28/272

[58] Field of Search ..... 28/271, 272, 273, 28/274, 275, 276; 226/97, 7; 281/75, 76

[56] References Cited

U.S. PATENT DOCUMENTS 4,941,242 7/1990 Nabulon .

FOREIGN PATENT DOCUMENTS 0110359 6/1984 European Pat. Off. .
0184625 6/1986 European Pat. Off. .
0249804 12/1987 European Pat. Off. .

OTHER PUBLICATIONS

European Search Report dated Sep. 26,1995 in Swiss Appln. No. 443/95–0.

*Primary Examiner*—C. D. Crowder

*Assistant Examiner*—Larry D. Worrell, Jr.

*Attorney, Agent, or Firm*—Burns, Doane, Swecker & Mathis, LLP

[57] ABSTRACT

A thread treating nozzle includes two relatively movable parts (10) and (12) which may be brought into mutual contact to define a thread treating passage and which may be moved apart to permit insertion of the thread. The part (12) is an elastic plate (12) supported by a plate mounting structure (120) which includes a housing member (122) containing a pressurizable chamber (200) in which a bridge member (201) is guided freely for movement as a piston by guide walls (206). To prevent the pressure medium contained in the cylinder space from escaping via the clearance between the guide walls (206) and the bridge member (201) a seal (204) is provided. The bridge member (201) includes a base plate (202) contacting the bottom (208) of the seal (204), and bridge members (203) are fitted on plate (202) to bear against the plate (12). This permits exertion of a homogeneous pressure on the plate (12) as the chamber is pressurized, causing the plate (12) to deform and adapt to the sealing surface on the nozzle part (10) to establish a sealing contact between the two nozzle parts.

9 Claims, 2 Drawing Sheets

THREAD TREATING NOZZLE WITH ELASTIC PLATE

The present invention relates to thread treating nozzles, and more specifically, to a new construction of an openable and closable thread treating nozzle.

BACKGROUND OF THE INVENTION

An openable and closable thread treating nozzle is shown in previously published European patent application Nos. 0184625A1 and 0249804A1 as well as in U.S. Pat. No. 4,941,242, the disclosures of which are incorporated herein by reference in their entireties. An object of the present invention is to provide nozzles of this general type with structures which permit the force for the closing of the thread treating nozzle to be spread homogeneously over the full length of the nozzle.

SUMMARY OF THE INVENTION

The present invention may be embodied in a nozzle made up of two parts between which the thread to be treated may be inserted while the proximate surfaces of the two parts are spaced from one another. The relative movement between the two parts causes them to close together, with the thread being disposed in a thread channel formed at the interface between them. The face portion of one of the two nozzle parts is elastic, and the closing forces are such that its shape is altered as necessary to provide a good seal between the adjacent faces of the two nozzle parts in the vicinity of the thread channel through the nozzle.

In accordance with the invention, the elastic nozzle part is carried by a housing which is moveable toward and away from the other part of the nozzle. The housing is provided with a piston-cylinder type of fluid pressure system through which the elastic nozzle part may be urged against the other nozzle part. In particular, the housing includes a fluid chamber into which pressurized fluid may be introduced, and a plate moveable in the chamber bridges the open end of the fluid chamber in the fashion of a piston. The outer surface of the bridge plate is in turn arranged to supply pressing forces to properly spaced apart locations on the back side of the elastic nozzle part to cause its shape to adapt to that of the surface of the other nozzle part. Lip seals are located within the fluid chamber and are movable with the bridge plate to prevent the escape of pressurized fluid.

BRIEF DESCRIPTION OF THE DRAWINGS

These and other features and advantages of the invention will be more fully appreciated from consideration of an embodiment to be described more fully below with reference to the accompanying drawings, in which.

DETAILED DESCRIPTION OF PREFERRED EMBODIMENT

Figure 1:
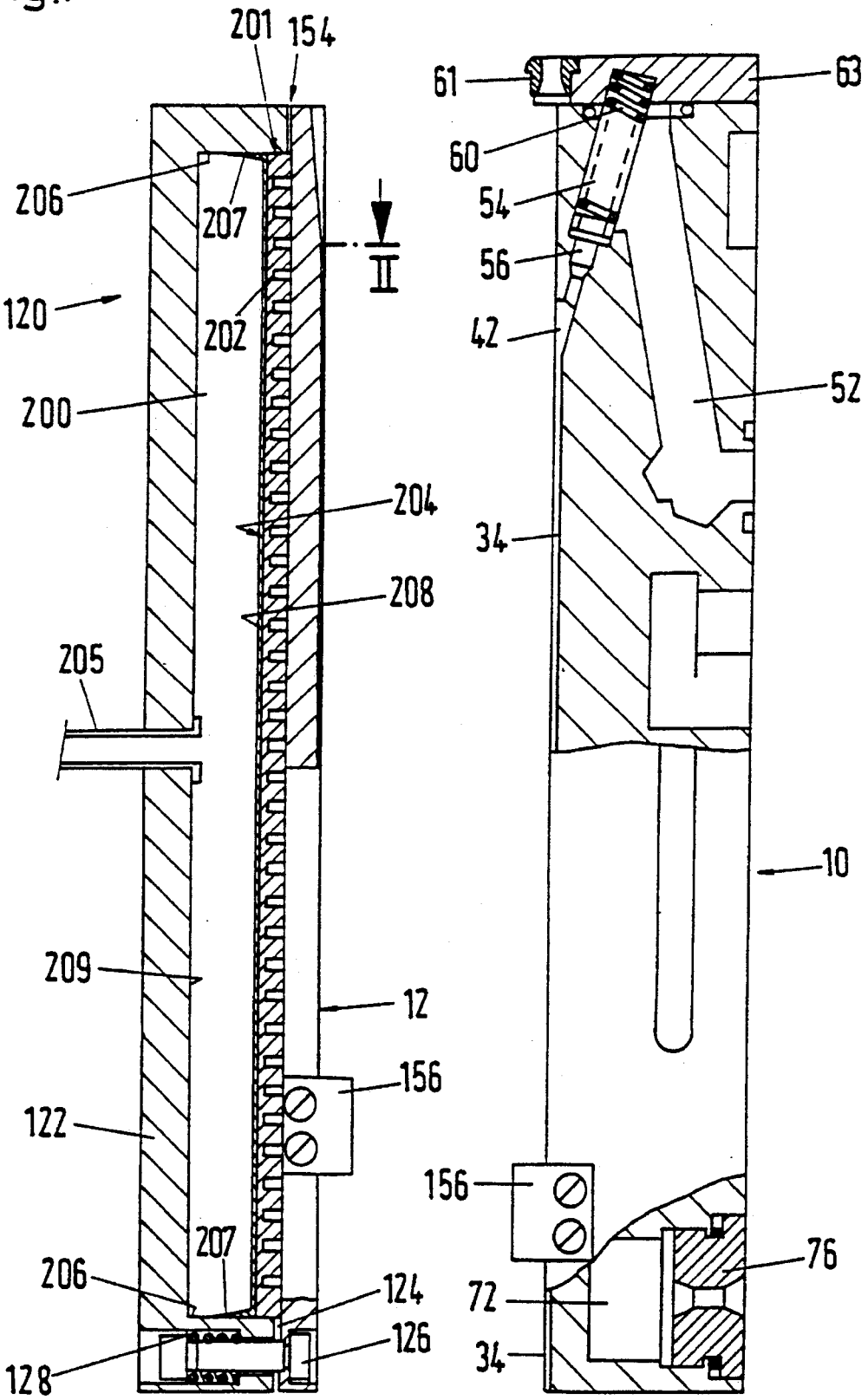
FIG. 1 is in part a side view and in part a partial section along the line I—I in FIG. 2 of a two-part thread texturizing nozzle according to the invention.

In general, an effort has been made to use the same reference characters in these drawings as those used in U.S. Pat. No. 4,941,242 and the other prior applications (particularly EP 0184625A1) referred to above, in order to facilitate reference to those disclosures for information concerning the basic structures and the operation of the thread texturizing nozzle shown in the drawings. In order to avoid redundant descriptions, the general design layout and the operation of the thread texturizing nozzle are not described again here.

Two nozzle parts are indicated by the numerals 10 and 12. The part 10 is mounted on a suitable support member (not shown) using fastening or fixation means. The part 10 takes the form of an elongated block, is made in one piece, and is provided with a plane surface 26 (see FIG. 2). The mounting of the part 12 will be described in more detail later in the present description.

The part 12 takes the form of an elongated plate-like element and is provided with a plane surface 28. If the nozzle is closed correctly the surfaces 26 and 28 are brought into mutual contact in such a manner that a seal is formed against lateral escape of texturizing fluid from a thread passage duct to be described later on.

The surface 26 of the part 10 is provided with a groove 34 extending from the downstream end of the block. The surface 28 of the part 12 is provided with a groove 36 extending from one end of the plate element to the other and which slightly widens at its entrance end (see FIG. 1). The widening of the groove is not, however, essential with respect to the present invention and can be dispensed with. If the surfaces 26 and 28 are engaged correctly, the grooves 34 or 36 are aligned congruently to form a passage or duct extending end to end throughout the nozzle.

This passage or duct defines a thread path through the nozzle and various details of it can be understood more fully from the earlier applications referred to above. The treating fluid is fed to an inlet port 42 (FIG. 1) where the thread and the fluid converge. The treating fluid is fed to the inlet port 42 via a bore 52 in the part 10. This bore 52 leads into a chamber 54 which in turn is connected via a metering tube 56 to the inlet port 42. The chamber 54 is open towards the upper end of the block 10 and is closed during operation by a cover plate 63 which can be removed to give access to the chamber 54 and to the metering tube 56. The tube 56 is held in its desired position by a compression spring 60 extending between the cover plate 63 and the tube 56. A thread guide 61 is mounted on the cover plate 63 to ensure correct guidance of the thread into the passage or duct.

A texturizing chamber (details of which are not shown) is formed adjacent to the downstream end of the thread passage by suitable formation of the block 10 and the plate 12 as shown in a European patent application 108205. The treating fluid passes out of the texturizing chamber sideways with respect to the thread passage via an outlet port 72 in the block 10, which port, in the illustrated embodiment, contains a flow-controlling throttle 76. The throttle 76, however, can be dispensed with if desired.

The plate-like element 12 is mounted on a plate mounting structure which as a whole is designated by the overall reference number 120. This structure 120 comprises a container-type support and housing element 122. As can be seen from the section in FIG. 2 the element 122 is provided with an opening, the function of which will be described further, and which faces the block 10, the plate-like element 12 being arranged in such a manner that the opening of the element 122 is covered. The element 12 is retained with respect to the element 122 by four retaining devices 124 (one only of which being shown in FIG. 1). Each of the retaining devices 124 comprises a sleeve 126 provided with an inside thread and with a pair of screws each of which is inserted into the sleeve from its other end. For reasons to be explained later, the retaining effect of the retaining devices 124 permits a certain degree of movement between the element 12 and the element 122. To this end between the element 12 and the sleeve 126 of each retaining device some play is permitted. A compression spring 128 is provided between the head of each screw and a contact surface on the element 122.

Inside the container-like element 122 a chamber or space 200 is provided and serves as the "cylinder" element of a piston-cylinder type of motion producing means. This chamber or cylinder can be pressurized and is provided with side walls 206 and a bottom surface 209. A bridge member 201 substantially covering the open end of the chamber or cylinder space 200 acts therein as a piston. The bridge member 201 consists of a bridge base plate 202 facing the cylinder space 200 and of a predetermined number of bridge support members 203 fitted against the plate 12. The freely movable bridge member 201 in this arrangement is guided along the walls 206.

Also disposed in the cylinder space 200 is a trough-shaped seal 204 hugging the walls 206 and the bridge base plate 202. This seals the cylinder space from the exterior.

A pressure medium inlet port 205 permits pressurizing the cylinder space 200 using a fluid pressure medium in order to exert a substantially homogeneously distributed pressure on the plate 12 over its whole length via the bridge member 201 and its support members 203.

In order to prevent any escape of the pressure medium from the cylinder space, the lateral walls of the trough-shaped seal 204 fitting against the guide walls 206 of the cylinder space are designed as lip seal walls 207. These are pressed against the guide walls 206 by the pressure medium, thus preventing any passage of the pressure medium towards the outside. The sealing walls 207 are integral parts of, and arranged adjacent to, a seal bottom 208 adjacent to and covering the surface of the bridge plate 202 facing the interior of the pressure chamber 200.

In an alternative embodiment the seal plate 208 can be provided with a frame-type opening (not shown), the frame strips being designed as lip seals activated in the same manner as the lateral lip seal walls 207.

The drawings (FIGS. 1 and 2) indicate that the overall outside dimensions of the plate 12 combined with its support structure 120 closely correspond to the dimensions of the block 10. Thus it is possible to mount the combination of the elements 12 and 120 in a mounting device (not shown) designed to take a pair of block-shaped nozzle parts.

Whatever mounting device is used to receive the block 10 and the combination of the elements 12 and 120, these parts are coordinated to a nozzle closing system. The latter may, for example, be of the type shown in European patent application No. 110359. A closing system of this type is provided with a "scissors-type" linkage, and the block 10 and the combination of the elements 12 and 120 are mounted on the arms of this scissors-type linkage. The arms of the scissors linkage are opened and closed using a suitable drive mechanism, e.g., using a pressure piston and cylinder unit such as the one shown in the above mentioned European patent application No. 110359. As the scissors-type linkage brings the nozzle parts together, the bevelled elements 156 (see FIG. 2 especially) prevent any misalignment so that a fixing bolt 158 on the plate 12 will be inserted into a positioning port 160 in the block 10 to ensure the required alignment of the grooves 34 and 36 and thus the proper formation of the thread passage duct. In FIG. 1, the bolt 158 is hidden behind the bevelled element 156 of the plate 12.

The material and the dimensions of the plate 12 are chosen in relation to the closing force of the closing system in such a manner that the plate is deformable under the influence of the closing force as the surface 28 is pressed against the surface 26.

Figure 2:
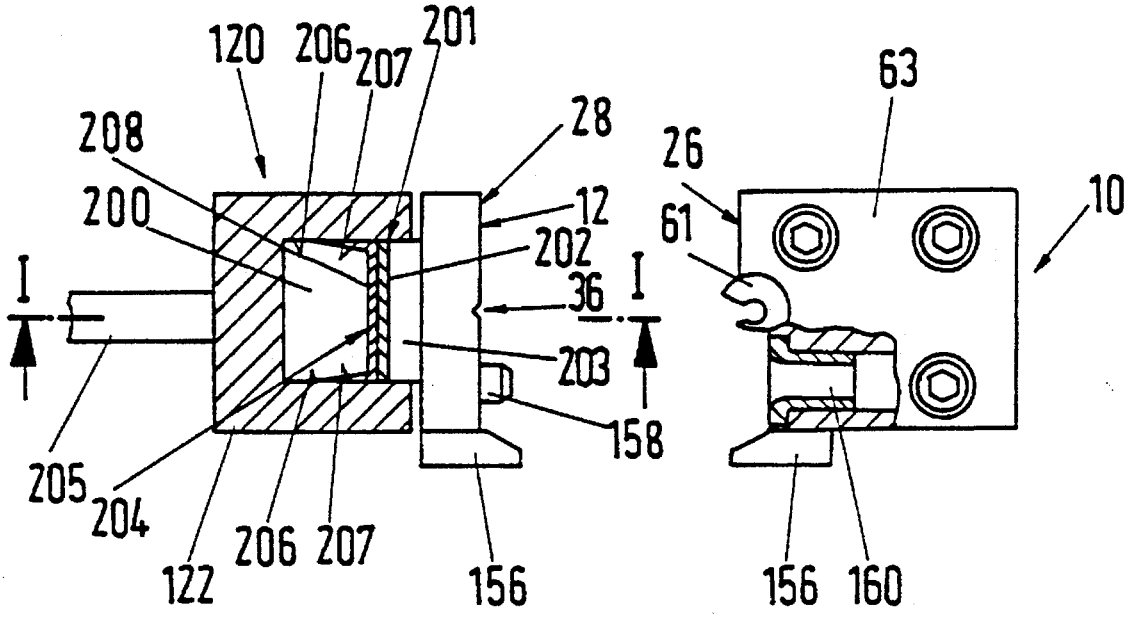
FIG. 2 is a top view of the elements shown in FIG. 1, with the left side portion being shown in a section along lines II—II in FIG. 1.

The bridge support members 203 are arranged in such a manner that each support member 203 covers a given contact area on the plate 12 and that the closing forces between these contact areas are distributed homogeneously. As can be seen in FIG. 2 each contact area covers the thread passage, seen at right angles to the contact area. Thus, the closing forces are applied to the areas in closest vicinity to the grooves 34 and 36 in a plurality of intervals distributed over the full length of the thread passage.

Let it be assumed that the surface 28 first contacts the surface 26 in a localized zone and at any random position. Since the closing forces are distributed along the full length of the nozzle, an interlinked closing momentum then tends to press the plate 12 against the block 10 at places beyond the zone of the first contact so that the other areas of the surfaces 26 and 28 are also brought into close contact. Since the plate 12 is, as mentioned before, elastically deformable, it can flex in response to the interlinked momentum in such a manner that the contact of the two surfaces 26 and 28 is ensured at least in the area of the central zone of each surface 26 and **28*k* (i.e. in the zones to both sides of the grooves 34 and 36**) and over the full length of the path of the thread passage.

In the above mentioned description, attention was concentrated upon the flexibility of the plate 12 ensuring a sealing contact, independent of unavoidable imprecision in manufacturing or mounting. On the other hand, certain adaptations of the plate 12 relative to the block 10 during the closing motion can be achieved owing to the pressure system within the housing 122 even without a flexible adaptation of the plate. An adaptation of this nature is mentioned in European patent application No. 110359 and the said application shows a mounting system for the blocks (such as, e.g., the block 10 and the combination of the elements 12 and 120) which permits the system to be mounted in such a manner that manufacturing or mounting imprecisions are taken care of. It may be suitable to provide a mounting system which takes up gross imprecisions and to choose a flexibility of the plate 12 sufficient to take care of fine adaptations in the local sealing contact.

The plate 12 preferably is made of metal, and for reasons to be mentioned later, it preferably provides good heat conductivity. In order to provide maximum flexibility of the plate, it is made as thin as possible without impairing the strength required for taking up the closing forces although the groove 36 is carved into the plate. The heat flow properties of the combination of the elements 12 and 120 quite clearly differ from the ones of the block 12 shown in European patent application No. 108205. Particularly, if a heating system is provided for the nozzle it is important that good head conductivity, as mentioned before, is ensured. If no heating system is provided, heat conductivity may be compromised on. The plate 12 is a wear part and is to be replaced eventually. The bridge member 201 not being a wear part, however, can be kept in use if the plate 12 is exchanged. The plate 12 also may be replaced by a plate of different shape if the nozzle is to be adapted to other applications.

The present invention has been described with reference to a texturizing nozzle. However, the present invention is not limited to an application of this nature; it is applicable in any thread treating nozzle, be it, e.g., in a nozzle generating twist or false twist or generating so-called "entanglements" (an "interlacing" nozzle) or even in a nozzle which simply forwards the thread. The invention is considered, however, to yield optimum potential if applied in texturizing nozzles in which considerable pressure is applied to the texturizing medium (e.g., air or steam).

What is claimed is:

1. A thread treating nozzle comprising a plurality of elements (10, 12) defining a thread treating passage duct, said elements being movable relative to each other for opening and closing the passage duct to permit insertion of a thread and at least one of said elements being an elastic plate (12); and means for exerting a closing force on a surface of the plate (12) to elastically deform the plate to such an extent that the plate (12) is adapted in configuration to establish sealing surface contact with another element (10) of the nozzle; said means for exerting the closing force including a housing (122) provided with guide walls forming a cylinder space (200) that can be pressurized using a pressurizing medium, and a bridge element (201) movable with respect to the housing and substantially taking up the cylinder space (200) so as to act as a piston, said bridge element (201) comprising a bridge base plate (202) and a plurality of bridge support members (203) fitting against said elastic plate (12), and said housing being provided with an inlet port (205) for the pressure medium in the cylinder space (200) and with a trough-shaped seal (204) which seals the cylinder space (200) by hugging the guide walls (206) of the cylinder space (200) and the bridge base plate.

2. A thread treating nozzle as claimed in claim 1, wherein said elastic plate (12) is mounted on a plate mounting structure (120).

3. A thread treating nozzle as claimed in claim 2, wherein said elastic plate (12) and plate support structure (120) are movable jointly towards and away from said other nozzle element (10).

4. A thread treating nozzle as claimed in claim 2, including support means (124) for supporting said plate (12) on said mounting structure (120) in a manner permitting relative movement between the said elements.

5. A thread treating nozzle as claimed in claim 2, wherein said plate mounting structure (120) comprises a container-like support and housing member (122), which is open on its side facing the other nozzle element (10) and wherein said plate (12) is arranged in such a manner that it covers this open side of the support and housing member (122).

6. A thread treating nozzle as claimed in claim 5, wherein the overall outside dimensions of the combination of the plate (12) and its mounting structure (120) approximately corresponds to the dimensions of the other nozzle element (10).

7. A thread treating nozzle as claimed in claim 5, wherein said means for exerting the closing force is provided in the support and housing member (122) and acts between the member (122) and the plate (12).

8. A thread treating nozzle as claimed in claim 1, wherein said seal (204) comprises a seal bottom plate (208) and lip seal walls (207) protruding therefrom with said seal bottom plate (208) hugging said bridge base plate (203) and said lip seal walls (207) hugging said guide walls (206) of the housing member (122), to limit the guide walls (206) together with a bottom surface (209) of the housing member (122).

9. A thread treating nozzle as claimed in claim 8, wherein said seal bottom plate (208) forms a frame comprising frame slats which also are designed as lip seals.

* * * * *